US006292077B1

(12) United States Patent
Kaizuka et al.

(10) Patent No.: US 6,292,077 B1
(45) Date of Patent: Sep. 18, 2001

(54) ELECTROMAGNETIC ACTUATOR

(75) Inventors: Masanori Kaizuka; Ryushiro Kaneko, both of Ibaraki (JP)

(73) Assignee: SMC Corporation, Tokyo (JP)

( * ) Notice: Subject to any disclaimer, the term of this patent is extended or adjusted under 35 U.S.C. 154(b) by 0 days.

(21) Appl. No.: 09/550,799

(22) Filed: Apr. 18, 2000

(30) Foreign Application Priority Data

Jun. 8, 1999 (JP) ..... 11-161178

(51) Int. Cl.[7] ..... H01F 3/00; H01F 7/08
(52) U.S. Cl. ..... 335/281; 335/255; 335/262
(58) Field of Search ..... 335/255, 256, 335/262, 266, 268, 270, 281; 251/129.09, 129.1, 129.15; 310/23, 30

(56) References Cited

U.S. PATENT DOCUMENTS 4,422,060 * 12/1983 Matsumoto et al. ..... 335/256
4,558,293 * 12/1985 Haneda et al. ..... 335/255

* cited by examiner

*Primary Examiner*—Ramon M. Barrera
(74) *Attorney, Agent, or Firm*—Oblon, Spivak, McClelland, Maier & Neustadt, P.C.

(57) ABSTRACT

To provide an electromagnetic actuator, having a large stroke and capable of producing the maximum thrust at a retreated stroke end, which is simple in structure and easy to manufacture. The electromagnetic actuator comprises an electromagnetic coil 1, a magnetic frame 3 arranged on the periphery thereof, a movable iron core 5 slidable in a central hole 4 of the coil 1, a first sleeve 6 coupled with the magnetic frame 3 at one end side of the central hole 4 of the coil, and a second sleeve 7 coupled with the magnetic frame 3 at the other end side of the central hole 4. The second sleeve 7 is spaced from the first sleeve 6 with a space (A+C) in the axial direction, and has an end thereof opposing the first sleeve 6 extended to a position in close proximity to the movable iron core 5 when the movable iron core 5 is at the retreated stroke end, but without being substantially fitted thereon, and extended to a position apart therefrom by a micro-distance A.

8 Claims, 5 Drawing Sheets

ELECTROMAGNETIC ACTUATOR

TECHNICAL FIELD

The present invention relates to an electromagnetic actuator for operating a movable iron core inserted through a central hole of an electromagnetic coil in the axial direction of the central hole by conducting a current through the electromagnetic coil, and more particularly relates to an electromagnetic actuator, having a large stroke, which is capable of producing a large thrust upon starting the electromagnetic actuator by conducting a current.

RELATED ART

Although well known is an electromagnetic actuator in that a movable iron core inserted through a central hole of an electromagnetic coil is made to be driven in the axial direction of the central hole by conducting a current through the electromagnetic coil, ordinarily, a thrust of the electromagnetic actuator is small upon starting thereof by conducting a current, and the thrust gradually increases after the electromagnetic actuator is started, as shown by a dotted line in FIG. 6.

However, for example, in operation (forcing out on a roller conveyor, pushing out from a shooter, or the like) of a variety of apparatuses and members of a manufacturing line, when a driving instruction signal of any sort is outputted, there are not a few occasions where an operation in response to the signal, for example, an operation of forcing out an object, or the like, is required to be performed as quickly as possible. In such an occasion when a quick operation is to be performed, a comparatively larger force is required for activation. For example, for forcing out an object of a certain weight, or activating a movable member, a force for activating it is required, while once it is activated, in many occasions, a large force is no more required as the operation can be continued by the inertia force. Therefore, if a thrust upon starting is increased and responsibility of an operation is improved, processing time in a variety of manufacturing lines can be shortened, and productivity thereof can be increased. Of course, when a driving instruction signal is outputted, the necessity for performing the quickest possible responsive operation is not limited to such problems of the manufacturing lines but also exists in a variety of technical fields.

For all that, a conventional electromagnetic actuator, having a small thrust upon starting by a conducted current as described heretofore, is unsuitable for such requirement, and in order that the requirement is satisfied by an actuator, the actuator is required to have a sufficiently increased thrust upon starting. However, the thrust upon starting cannot be so much increased as to cause a damage to an object on which the thrust is applied, and therefore it is also necessary to somewhat adjust the thrust while sufficiently increasing the thrust upon starting.

DISCLOSURE OF INVENTION

The present invention has been made to solve such problems, and a technical object thereof is to provide an electromagnetic actuator having a large stroke which is adapted to maximize a thrust thereof upon starting when a movable iron core is started to advance from the retreated stroke end.

Another technical object of the present invention is to provide an electromagnetic actuator, a thrust thereof is made to be somewhat adjustable while producing the maximum thrust upon starting of the electromagnetic actuator.

Still another technical object of the present invention is to provide the above-described actuators which are simple in structure and easy to manufacture.

In order to achieve the above-described technical objects, an electromagnetic actuator of the present invention has an electromagnetic coil, a magnetic frame made of a magnetic material arranged on the periphery of the electromagnetic coil, and a movable iron core which is inserted through a central hole of the coil and is slidable in the axial direction of the central hole of the coil, and the electromagnetic actuator is characterized by comprising a first sleeve which is made of a magnetic material to be magnetically coupled with the magnetic frame at one end side of the central hole of the coil, and mutually engaged with the movable iron core over the entire stroke of the movable iron core, and a second sleeve which is made of a magnetic material to be magnetically coupled with the magnetic frame at the other end side of the central hole, and spaced apart from the first sleeve, and an end thereof opposing the first sleeve is in close proximity to the movable iron core at the maximum stroke end but not in engagement therewith.

In the electromagnetic actuator having the above-described configuration, when a current is conducted through the electromagnetic coil in a state a movable iron core is at the retreated stroke end, a magnetic flux is generated on a periphery of the coil. However, since there is a space in the axial direction between the first sleeve and the second sleeve, the magnetic flux passes through inside the movable iron core for the space. At this time, since an end of the second sleeve opposing the first sleeve is extended to a position in close proximity to the movable iron core, when the magnetic flux passes the portion in high density, a large electromagnetic attraction in the axial direction is exerted between the second sleeve and the movable iron core, and accordingly, the maximum thrust can be produced in the movable iron core upon starting by conducting a current.

When the movable iron core is started to move and a portion thereof is inserted into the second sleeve, components in the radiating direction of the magnetic flux between the second sleeve and the movable iron core increase, and the electromagnetic attraction being exerted in the axial direction between them is gradually oriented toward the radiating direction which orthogonally crosses the thrust. Since the oriented force increases in proportion to an area of the second sleeve overlapped with the movable iron core, in accordance with moved amount of the movable iron core, the thrust gradually decreases.

However, as driving of an object to be driven can be started by the maximum thrust available upon starting of the electromagnetic actuator described above, the desired objects can be attained.

In the above-described electromagnetic actuator, the diameter of the front end at the second sleeve side of the movable iron core can be reduced for adjusting the thrust upon starting, thereby the thrust can be somewhat adjusted while producing the maximum thrust in the vicinity of the retreated stroke end.

Further, the first sleeve and the second sleeve can be concentrically joined by a bobbin which is wound by an electromagnetic coil, or a guide tube made of a nonmagnetic material can be inserted into the first sleeve and the second sleeve to have them concentrically joined, thereby the movable iron core can be operated in a stabilized way.

Furthermore, in the above-described electromagnetic actuator, the first sleeve and/or the second sleeve can be formed by rolling a plate made of a magnetic material, thereby enabling to provide the electromagnetic actuator which is simple in structure and easy to manufacture.

DETAILED DESCRIPTION OF THE INVENTION

Figure 1:
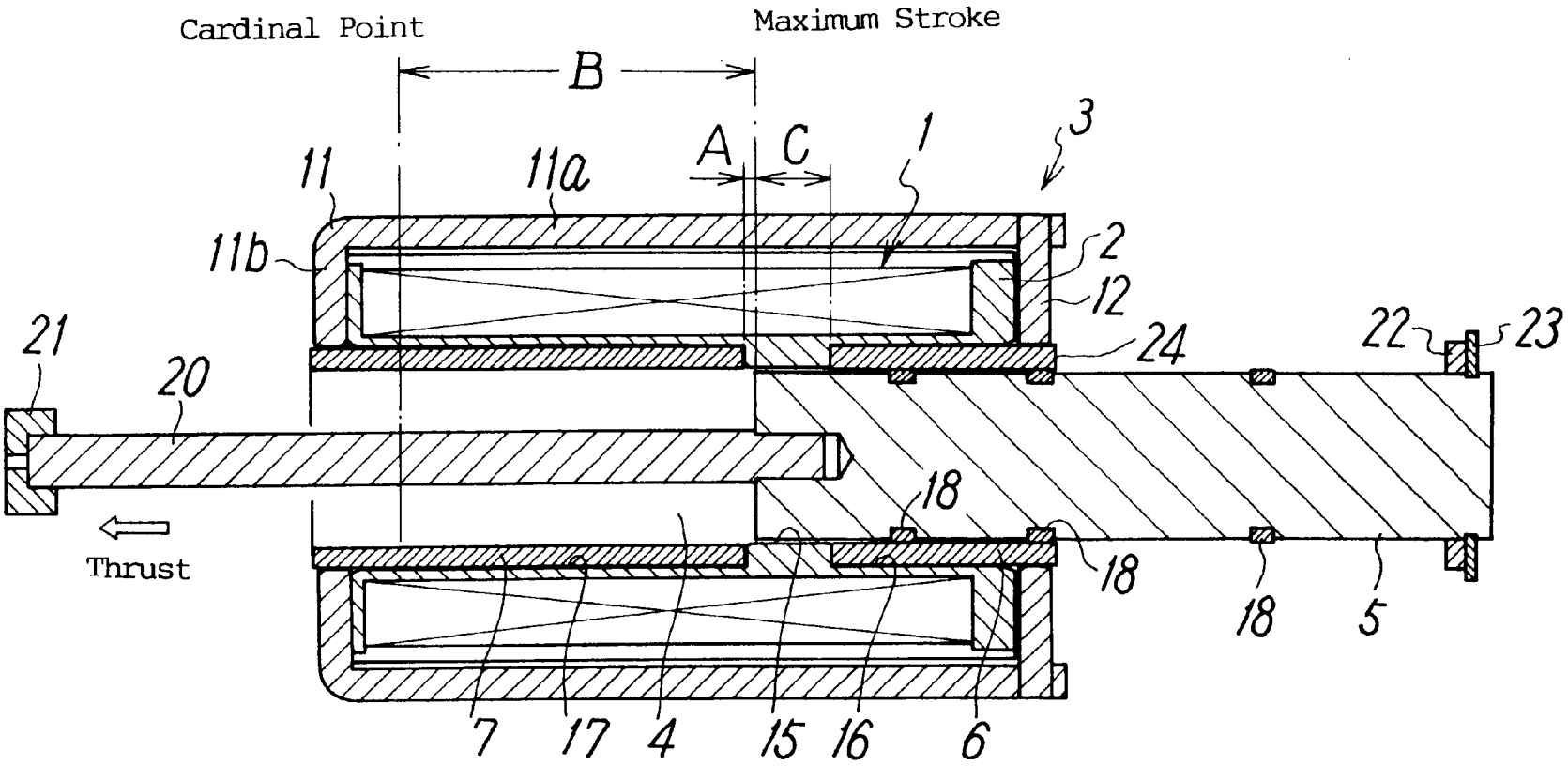
FIG. 1 shows a cross-sectional view of a first embodiment of an electromagnetic actuator according to the present invention.

FIG. 1 shows a first embodiment of an electromagnetic actuator according to the present invention.

The electromagnetic actuator comprises an electromagnetic coil 1 wound around a bobbin 2, a magnetic frame 3 made of a magnetic material and arranged on a periphery of the coil, a movable iron core 5 being inserted through a central hole 4 of the coil 1 and slidable in the axial direction of the central hole, and a first sleeve 6 and a second sleeve 7 which are coupled with the magnetic frame 3 as major constituting elements thereof.

The magnetic frame 3 made of the magnetic material arranged on the periphery of the electromagnetic coil 1 comprises a frame body 11 having a bent portion 11*b* which is bent toward the central hole 4 of the coil at an end of an outer periphery 11*a*, and a plate 12 fixed at an opposing end relative to the bent portion 11*b* of the frame body 11, to constitute a magnetic path on the outer periphery of the coil 1.

Further, the first sleeve 6 is made of a magnetic material and coupled with the magnetic frame 3 at an end side of the central hole 4 of the coil 1, namely at the plate 12 side of the magnetic frame 3. The first sleeve 6 is arranged to mutually engage with the movable iron core 5 over an entire stroke of the movable iron core so as to be positioned on the periphery of the movable iron core 5 even when the movable iron core 5 is at the retreated stroke end as shown in FIG. 1. More particularly, the first sleeve 6 is extended from an inner end of the plate 12 which constitutes a part of the magnetic frame 3 into the central hole 4 of the coil 1, and structured to end a distance C in front of an end face of the movable iron core 5 which is at the retreated stroke end.

On the other hand, the second sleeve 7 is made of a magnetic material and coupled with the other end of the central hole 4 of the coil, namely with the bent portion 11*b* side of the frame body 11. The second sleeve 7 has an end thereof spaced in the axial direction from the first sleeve 6 (distance being A+C), and when the movable iron core 5 is at the retreated stroke end a FIG. 1, an end thereof opposing the first sleeve 6 is extended to a position in close proximity to the movable iron core 5, but is not substantially fitted thereon, and is extended to a position spaced therefrom by a micro-distance A. The position is required to be a position where a large electromagnetic attraction in the axial direction is exerted with the movable iron core 5 which is positioned at the retreated stroke end, when a current is conducted through the coil 1, and depending on situation, the distance A may be substantially zero. It should be noted that in order to increase a stroke of the movable iron core 5, ordinarily, the second sleeve 7 is formed to be more elongated than the first sleeve 6.

The first sleeve 6 and the second sleeve 7 are required to be concentrically arranged as the movable iron core 5 moves inside thereof at a high speed. For the purpose, on an inner peripheral surface of the bobbin 2 having the electromagnetic coil 1 wound therearound, a convexity 15 is provided for setting a space (A+C) between the first sleeve 6 and the second sleeve 7, and on both sides of the convexity 15, depressed portions 16 and 17 are provided for engaging the first sleeve 6 and the second sleeve 7 therewith, and by having the sleeve 6 and the sleeve 7 tightly engaged with the depressed portions 16 and 17, both sleeves 6 and 7 are concentrically joined together to have inner surfaces thereof smoothly coupled.

The movable iron core 5 has a required number of guide rings 18 fitted on the periphery thereof for smoothening sliding of the movable iron core 5 inside the first sleeve 6 and the second sleeve 7. Of the guide rings 18, it is desirous to have at least two of them inserted all the time into the central hole 4. Further, at one end of the movable iron core 5, a push rod 20 made of a nonmagnetic material for transmitting a generated thrust is stuck out therefrom, and the tip of the push rod is covered by a cap 21. Furthermore, on the other end of the movable iron core 5, retained by a collar 23 is a cushion member 22 for setting a stop position for the movable iron core 5 by abutting to a receiving seat 24 formed on an outer end of the first sleeve 6, when the movable iron core 5 is driven by a current conducted through the coil 1. The push rod 20 can be fixed to the movable iron core 5 by means of injection, welding, or the like, while the cap 21 at the tip thereof can be formed with a synthetic resin, rubber, metal, or the like, and adhered to the tip of the push rod by means of injection, arresting, welding, or the like.

In the electromagnetic actuator having above-described configuration, when a current is conducted through the electromagnetic coil 1 in a state as shown in FIG. 1 where the movable iron core 5 is at the retreated stroke end, a magnetic flux is generated on the periphery of the coil 1, however, as there is a space (A+C) in the axial direction between the first sleeve 6 and the second sleeve 7, the magnetic flux passes through inside the movable iron core 5 for the space. At the time, since an end of the second sleeve 7 opposing the first sleeve 6 is extended to a position in close proximity to the movable iron core 5, when the magnetic flux passes through the portion in high density, a large electromagnetic attraction in the axial direction is exerted between the second sleeve 7 and the movable iron core 5, and consequently the maximum thrust can be produced for the movable iron core upon starting by conducting a current.

When the movable iron core 5 is started to move, and after moving by a distance A, a portion thereof is inserted into the second sleeve 7, then components in the radiating direction of the magnetic flux between the second sleeve 7 and the movable iron core 5 is increased, and the electromagnetic attraction being exerted in the axial direction therebetween are gradually oriented toward the radiating direction which orthogonally crosses the thrust. Since the oriented force increases in proportion to an area of the second sleeve 7 overlapped by the movable iron core, the thrust gradually decreases in accordance with moved amount of the movable iron core 5. The movable iron core 5, after being driven for a stroke B, comes to stop as a cushion member 22 abuts a receiving seat 24 of the first sleeve 6. Movement of the movable iron core 5 is taken out by way of a push rod 20 coupled thereto.

Figure 6:
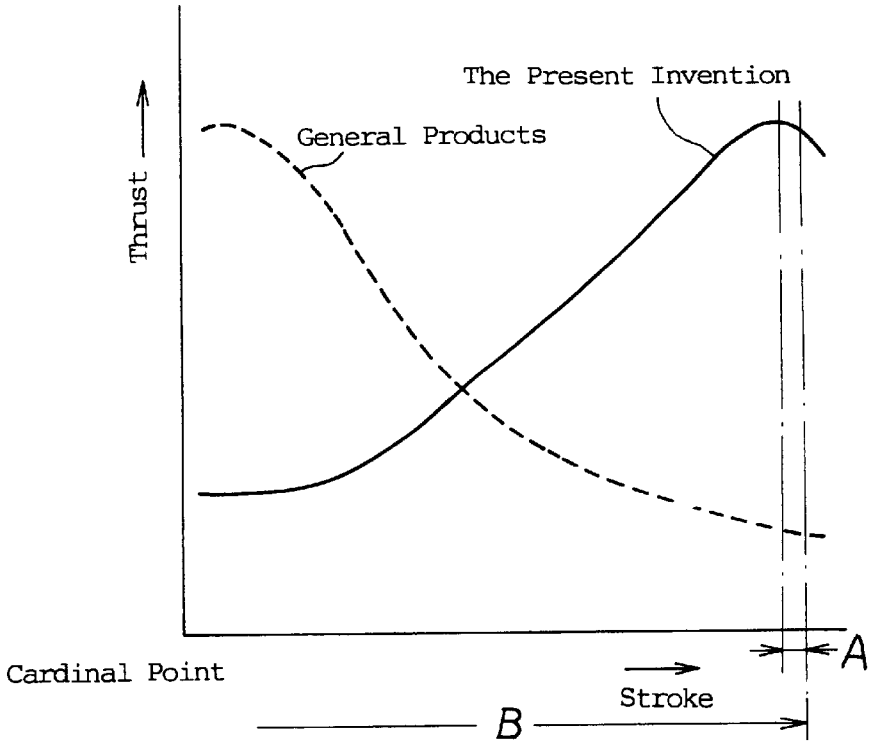
FIG. 6 shows an explanatory chart describing relationship between a stroke and a thrust.

FIG. 6 schematically shows relationship between a stroke and a thrust of a movable iron core of the present embodiment in comparison with a general electromagnetic actuator. In the general electromagnetic actuator, a thrust upon starting by conducting a current is small as shown by a dotted line in the drawing, and the thrust gradually increases after the operation is started. In the electromagnetic actuator of the present embodiment, however, the thrust can be maximized in the vicinity of the starting time of the operation enabling to drive an object to be driven by a large thrust, as shown by a solid line in the drawing, thus enabling to achieve the above-described objects, though the thrust decreases thereafter.

A preferable embodiment of the above-described electromagnetic actuator, in an exemplary structure of FIG. 1, may be implemented by; stroke B≧10 mm, A=0 to 5 mm, C≧2 mm, and [length of the first sleeve] [length of the second sleeve]. However, these numerals do not constitute restrictive conditions to the present invention in any meaning.

Figure 2:
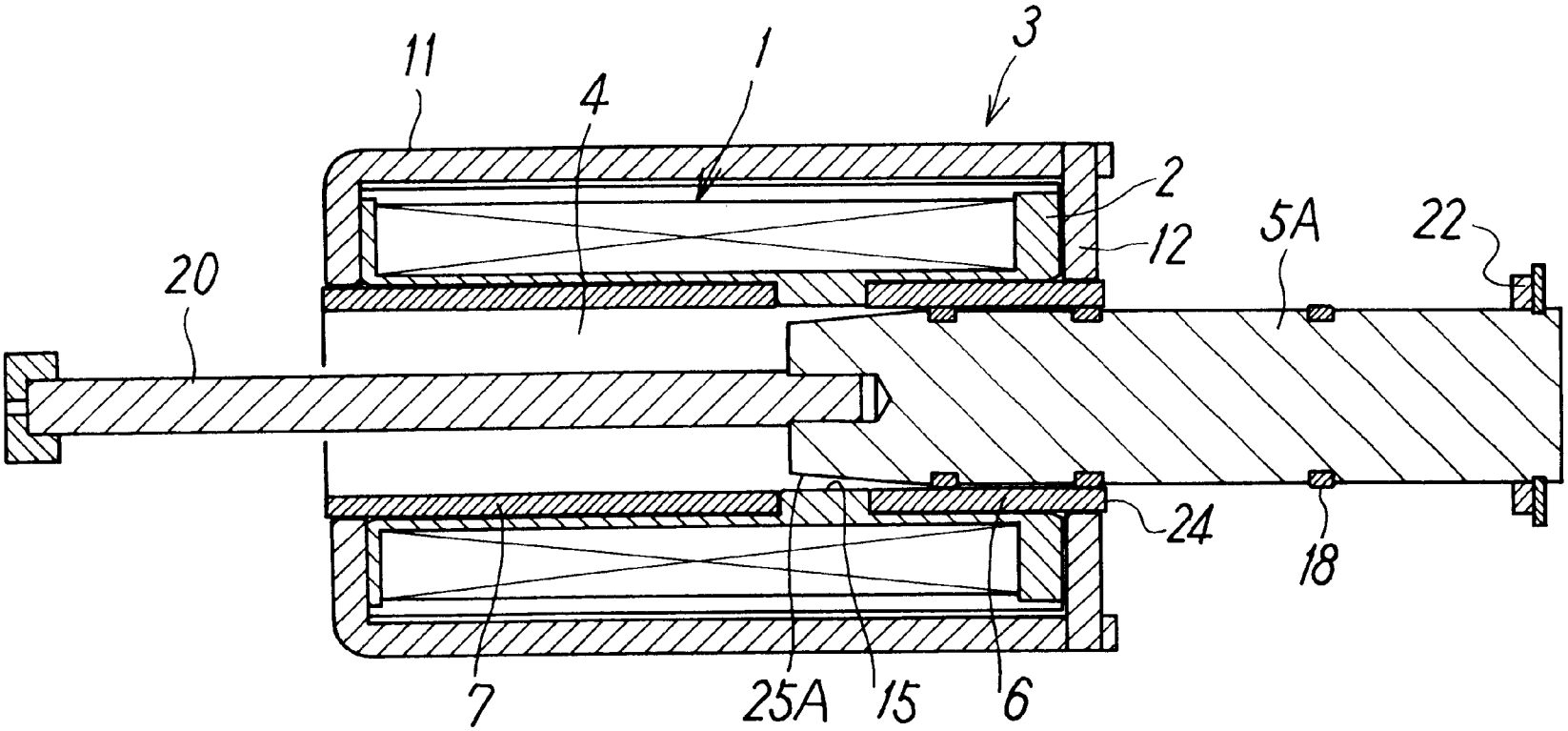
FIG. 2 shows a cross-sectional view of a second embodiment of an electromagnetic actuator according to the present invention.
Figure 3:
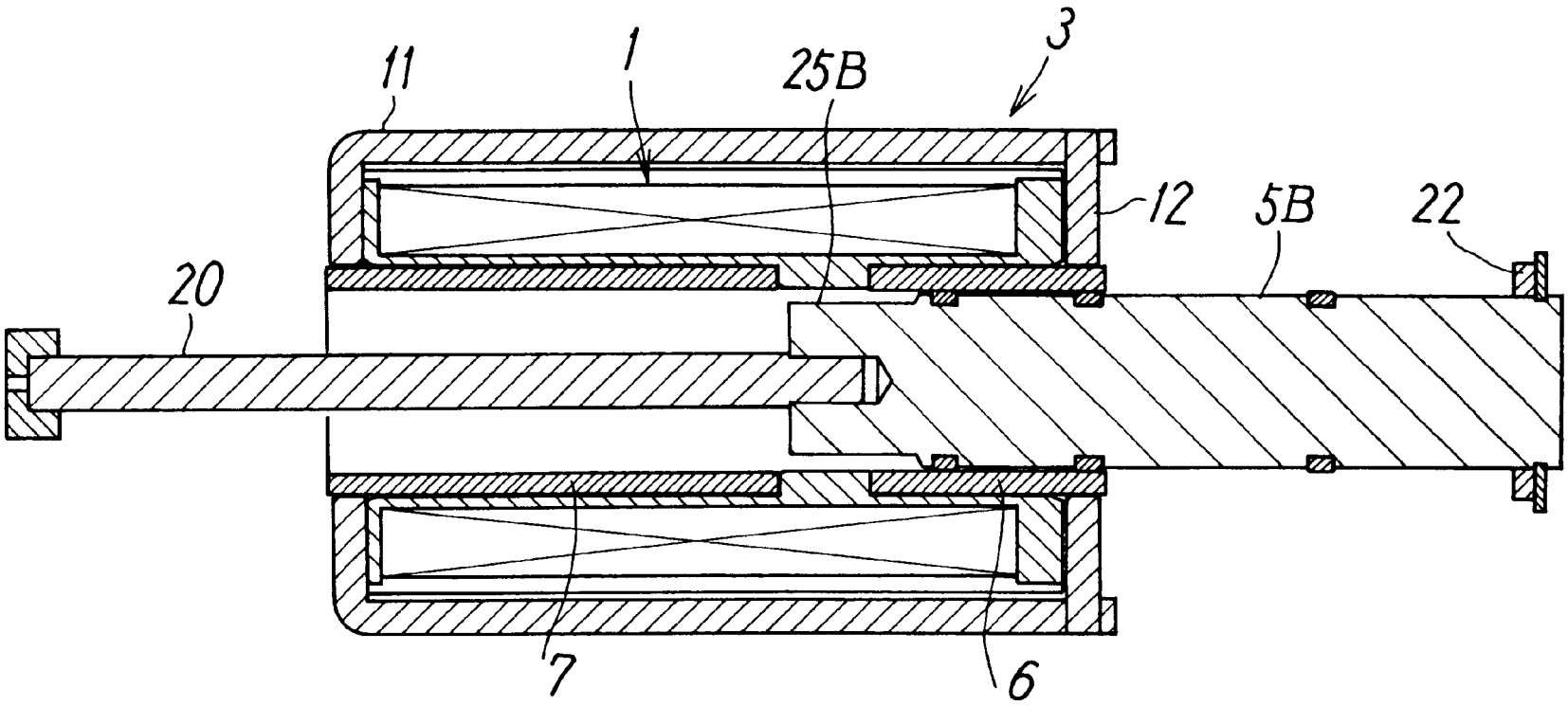
FIG. 3 shows a cross-sectional view of a third embodiment of an electromagnetic actuator according to the present invention.

FIG. 2 and FIG. 3 respectively show a second embodiment and a third embodiment of an electromagnetic actuator according to the present invention. Since the electromagnetic actuators of these embodiments have substantially the same configuration as the first embodiment except for structure of a movable iron core 5A and a movable iron core 5B, description is made only of the different portions. The major portions of the second embodiment and the third embodiment which are common with the first embodiment are marked by the same symbols in the drawings as the first embodiment and descriptions thereof are omitted.

The movable iron core 5A shown in FIG. 2 is provided with a tapered cut-away 25A which is formed by cutting to taperingly reduce the diameter of an end thereof on the sleeve 7 side for adjusting a thrust upon starting. By the tapered cut-away 25A, a thrust of the movable iron core 5A can be adjusted in accordance with degree of cutting of the cut-away 25A, while producing the maximum thrust in the vicinity of the retreated stroke end.

On the other hand, the movable iron core 5B shown in FIG. 3 is similarly provided with a cut-away 25B at the second sleeve 7 side end of the movable iron core 5B for adjusting a thrust. The cut-away 25B is, however, formed by cutting to uniformly reduce the diameter of the movable iron core 5B in a step-shape. Therefore, the thrust can be adjusted in accordance with degree of the cutting but in an aspect different from the embodiment shown in FIG. 2.

It should be noted that the above-described cut-away may have a variety of figures suited for the thrust adjustment, in addition to structures illustrated in FIG. 2 and FIG. 3.

Figure 4:
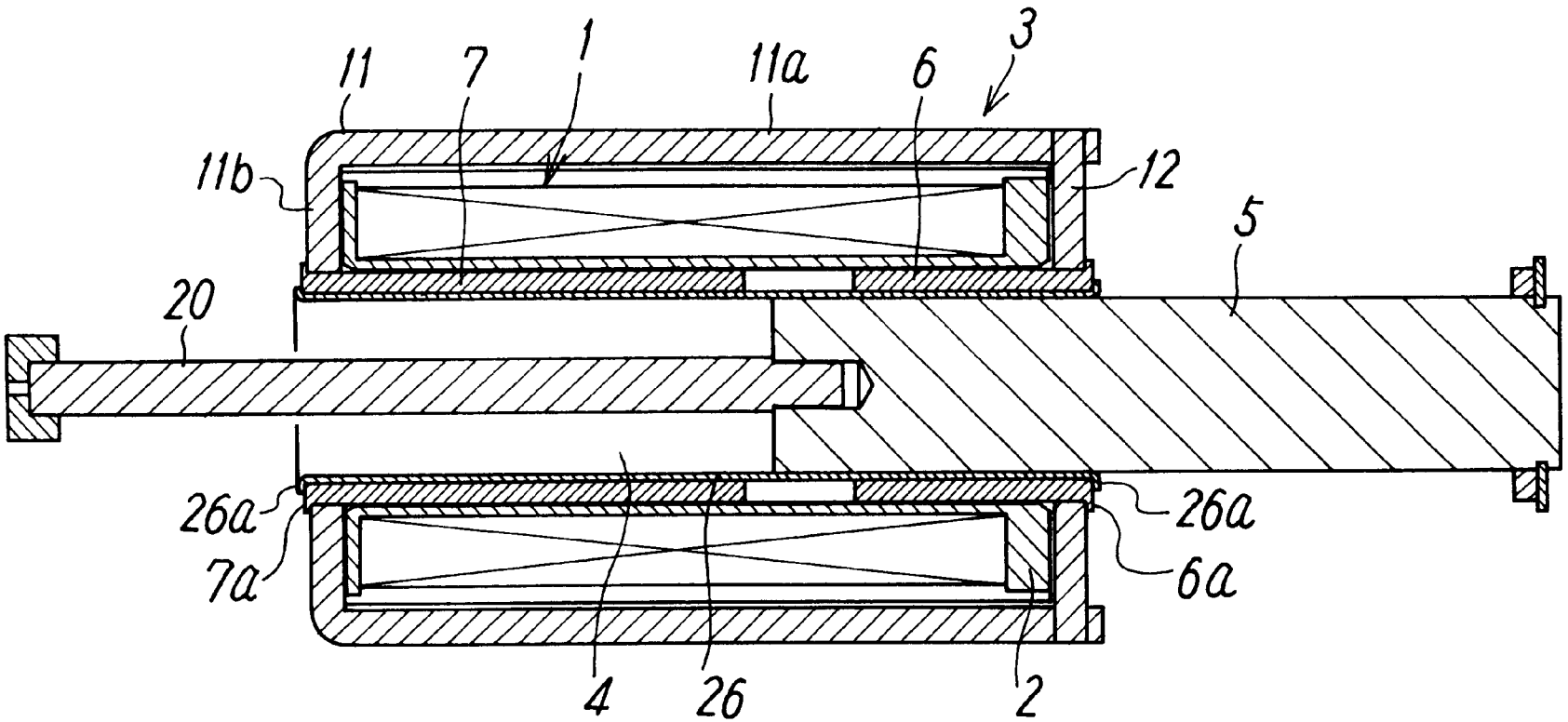
FIG. 4 shows a cross-sectional view of a fourth embodiment of an electromagnetic actuator according to the present invention.

FIG. 4 shows a configuration of a fourth embodiment of an electromagnetic actuator according to the present invention. In the fourth embodiment, a guide tube 26 made of a nonmagnetic material is inserted into the first sleeve 6 and the second sleeve 7, thereby the first sleeve 6 and the second sleeve 7 are concentrically joined. When the guide tube 26 is used, bent portions 6*a* and 7*a* are formed in advance at outer ends respectively of the first sleeve 6 and the second sleeve 7. Until the bent portions 6*a* and 7*a* abut the outer ends of the magnetic frame 3, the first sleeve 6 and the second sleeve 7 are inserted into the central hole 4 of the coil 1. Then, the guide tube 26 is inserted into both sleeves 6 and 7, and by forming outwardly bending bent portions 26*a* respectively at both ends of the guide tube 26, both sleeves 6 and 7 can be simply secured at required positions together with the guide tube 26. Further, when the guide tube 26 is secured in the central hole 4 of the coil, a bent portion 26*a* may be formed in advance at one end thereof.

When such guide tube 26 is used, since the movable iron core 5 slides inside the single guide tube 26, it is not always necessary to smoothen the sliding by providing the guide rings 18 on the movable iron core 5 as in the first to the third embodiments. Instead, an appropriate structure may be to have the movable iron core directly slid in the guide tube 26. Moreover, for the guide tube 26, a material suitable for sliding of the movable iron core 5 may be used.

Other structure and operation of the fourth embodiment are not changed from the first embodiment, and therefore the same or the corresponding portions thereof in the drawing are marked with the same symbols as in the first embodiment and descriptions thereof are omitted.

Figure 5:
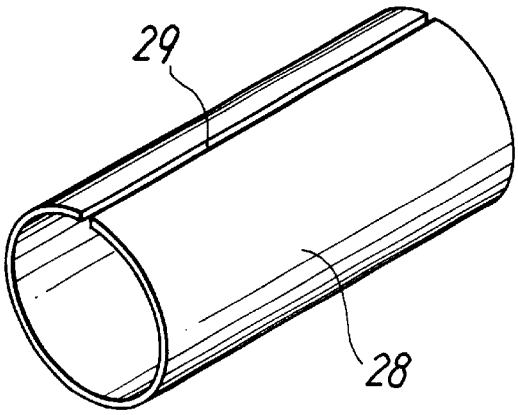
FIG. 5 shows a perspective view of an exemplary structure of a first and a second sleeve.

Further, in the electromagnetic actuators of the above-described respective embodiments, the first sleeve 6 and the second sleeve 7 may be formed by rolling a square plate 28 made of a magnetic material into a cylinder as shown in FIG. 5. In this case, it is not necessary to couple joining portions of both ends of the rolled plate 28, and a joint clearance 29 causes no problem.

The guide tube 26 used in the fourth embodiment may also be formed by rolling a square plate made of nonmagnetic material into a cylinder. In this case as well, it is not necessary to couple joining portions of both ends of the rolled plate, and a joint clearance causes no problem.

According to the electromagnetic actuators of the present invention described in detail heretofore, obtainable is an electromagnetic actuator having a large stroke which is made to produce the maximum thrust at the retreated stroke end, and also obtainable is an electromagnetic actuator, the thrust thereof is made somewhat adjustable while producing the maximum thrust in the vicinity of the retreated stroke end. Moreover, the actuators can be made to be simple in structure and easy to manufacture.

What is claimed is:

1. An electromagnetic actuator comprising:

an electromagnetic coil wound around a bobbin having a central hole, a magnetic frame made of a magnetic material arranged on a periphery of said coil, a movable iron core which is inserted through the central hole of said bobbin and is slidable in an axial direction of said central hole, a first sleeve which is cylindrically made of a magnetic material, magnetically coupled with said magnetic frame by being inserted into one end side of said central hole, and mutually engaged with said movable iron core over an entire stroke of said movable iron core, and a second sleeve which is cylindrically made of a magnetic material, magnetically coupled with said magnetic frame by being inserted into the other end side of said central hole, and spaced from said first sleeve in the axial direction of said central hole, said second sleeve having an end opposing said first sleeve in close proximity to said movable iron core but not in engagement therewith at a retreated stroke end of said movable iron core, said second sleeve being arranged to be gradually engaged with said movable iron core as said movable iron core advances.

wherein said movable iron core extends outside of said magnetic frame when at the retreated stroke end.

2. An electromagnetic actuator according to claim 1, wherein an end of the second sleeve side of said movable iron core has a radius which is made smaller than other portions in order to adjust a thrust upon starting.

3. An electromagnetic actuator according to claim 1, wherein an annular convexity is provided on an inner peripheral surface of the central hole of said bobbin, and by inserting both said sleeves into the central hole to a position touching the convexity, a space between both sleeves is set by the convexity.

4. An electromagnetic actuator according to claim 2, wherein an annular convexity is provided on an inner peripheral surface of the central hole of said bobbin, and by inserting both said sleeves into the central hole to a position touching the convexity, a space between both sleeves is set by the convexity.

5. An electromagnetic actuator comprising:

an electromagnetic coil wound around a bobbin having a central hole, a magnetic frame made of a magnetic material arranged on a periphery of said coil, a movable iron core which is inserted through the central hole of said bobbin and is slidable in an axial direction of said central hole, a first sleeve which is cylindrically made of a magnetic material, magnetically coupled with said magnetic frame by being inserted into one end side of said central hole, and mutually engaged with said movable iron core over an entire stroke of said movable iron core, and a second sleeve which is cylindrically made of a magnetic material, magnetically coupled with said magnetic frame by being inserted into the other end side of said central hole, and spaced from said first sleeve in the axial direction of said central hole, said second sleeve having an end opposing said first sleeve in close proximity to said movable iron core but not in engagement therewith at a retreated stroke end of said movable iron core, said second sleeve being arranged to be gradually engaged with said movable iron core as said movable iron core advances, wherein a guide tube made of a nonmagnetic material in a length extending over an entire length of the first sleeve and the second sleeve is inserted into insides of said both sleeves.

6. An electromagnetic actuator according to claim 5, wherein an end of the second sleeve side of said movable iron core has a radius which is made smaller than other portions in order to adjust a thrust upon starting.

7. An electromagnetic actuator according to claim 1, wherein at least one of said first sleeve and said second sleeve is a cylindrically rolled plate made of a magnetic material.

8. An electromagnetic actuator comprising:

an electromagnetic coil wound around a bobbin having a central hole, a magnetic frame made of a magnetic material arranged on a periphery of said coil, a movable iron core which is inserted through the central hole of said bobbin and is slidable in an axial direction of said central hole, a first sleeve which is cylindrically made of a magnetic material, magnetically coupled with said magnetic frame by being inserted into one end side of said central hole, and mutually engaged with said movable iron core over an entire stroke of said movable iron core, and a second sleeve which is cylindrically made of a magnetic material, magnetically coupled with said magnetic frame by being inserted into the other end side of said central hole, and spaced from said first sleeve in the axial direction of said central hole, said second sleeve having an end opposing said first sleeve in close proximity to said movable iron core but not in engagement therewith at a retreated stroke end of said movable iron core, said second sleeve being arranged to be gradually engaged with said movable iron core as said movable iron core advances, wherein said movable iron core has a push rod made of nonmagnetic material for pushing a work at a front end thereof, and a cushion member at a rear end thereof for abutting an end of said first sleeve for buffering a shock at an advanced stroke end.

* * * * *